United States Patent [19]

Nehls

[11] Patent Number: 4,895,331

[45] Date of Patent: Jan. 23, 1990

[54] SHELF BRACKET

[75] Inventor: Charles O. Nehls, Allen Park, Mich.

[73] Assignee: Unistrut International Corp., Ann Arbor, Mich.

[21] Appl. No.: 331,235

[22] Filed: Mar. 31, 1989

[51] Int. Cl.[4] ..... A47G 29/02

[52] U.S. Cl. ..... 248/245; 108/108; 211/193; 248/235; 248/297.2

[58] Field of Search ..... 248/245, 244, 243, 241, 248/247, 295.1, 297.2, 235, 250; 211/193, 192, 208; 108/108, 109, 110; 403/187, 199

[56] References Cited

U.S. PATENT DOCUMENTS

| | | | |
|---|---|---|---|
| 2,719,692 | 10/1955 | Gredell . | |
| 2,737,268 | 3/1956 | Smith . | |
| 3,049,161 | 8/1962 | Attwood | 411/81 |
| 3,335,992 | 8/1967 | Frazier | 248/245 |
| 3,472,476 | 10/1969 | Johnson . | |
| 3,489,291 | 1/1970 | Frazier . | |
| 4,163,537 | 8/1979 | Mourgue | 248/97.2 X |
| 4,192,424 | 3/1980 | Allsop | 248/297.2 X |
| 4,519,521 | 5/1985 | Frazier | 248/245 X |

FOREIGN PATENT DOCUMENTS

| | | | |
|---|---|---|---|
| 0796854 | 6/1958 | United Kingdom | 248/245 |
| 1166851 | 10/1969 | United Kingdom | 248/245 |

*Primary Examiner*—Ramon O. Ramirez

*Attorney, Agent, or Firm*—Gifford, Groh, Sheridan, Sprinkle & Dolgorukov

[57] ABSTRACT

A cantilevered shelf support for installation on a vertically extending channel having a face containing a longitudinally extending slot bordered by inwardly projecting flanges. The shelf support has a mounting bracket which is aligned and bolted to the vertical channel. A support bracket having a horizontally shelf engaging surface is aligned and assembled to the mounting plate without further hardware.

11 Claims, 1 Drawing Sheet

Fig-1
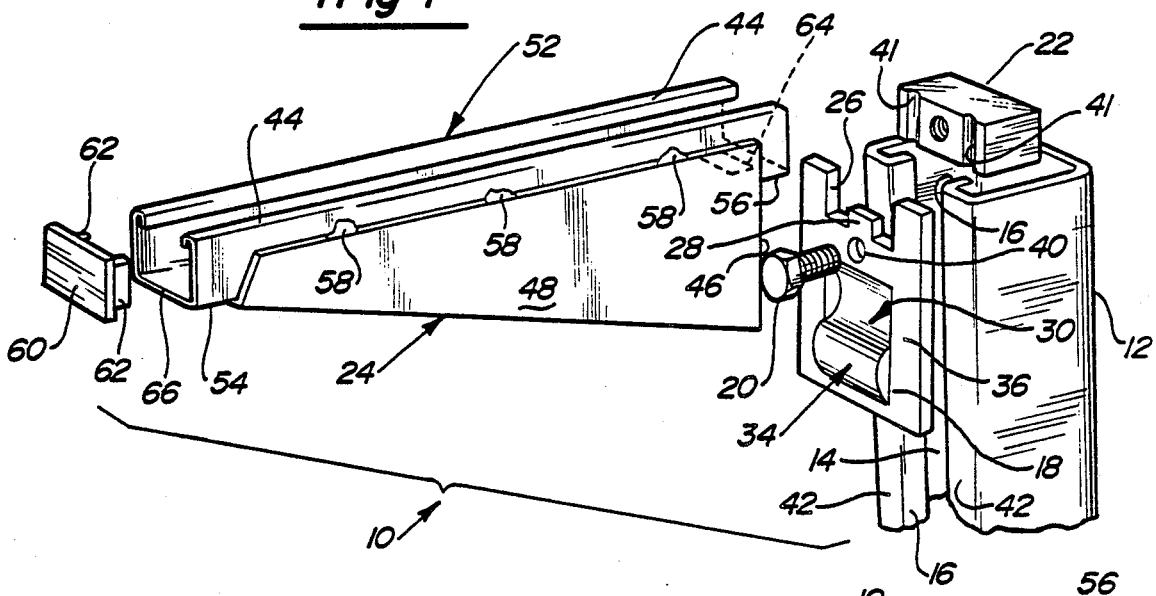
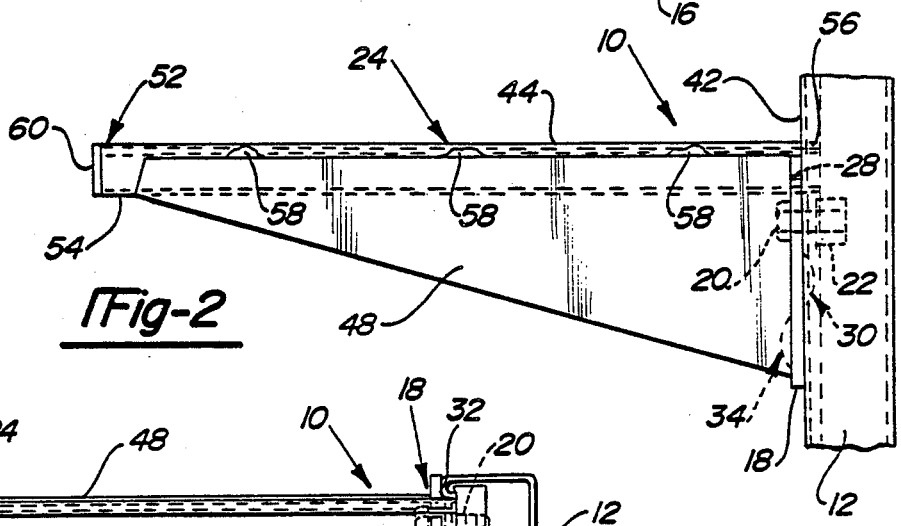
Fig-2
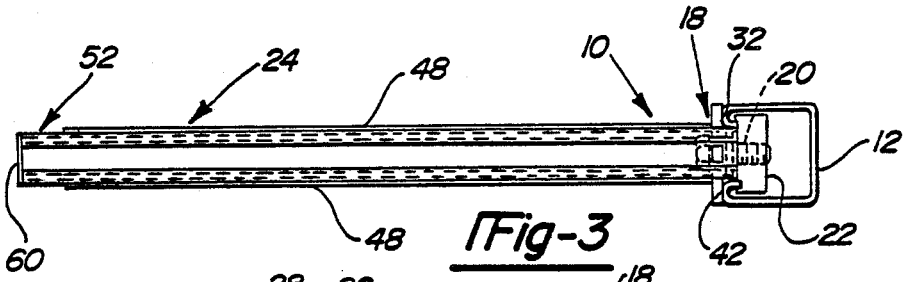
Fig-3
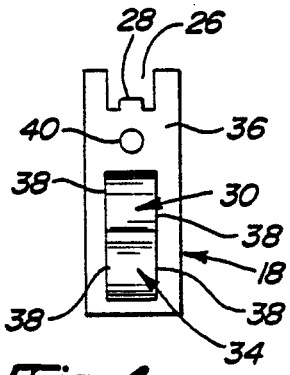
Fig-4
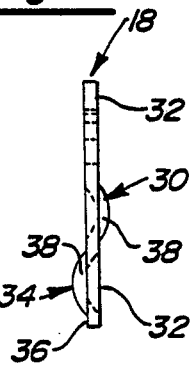
Fig-5
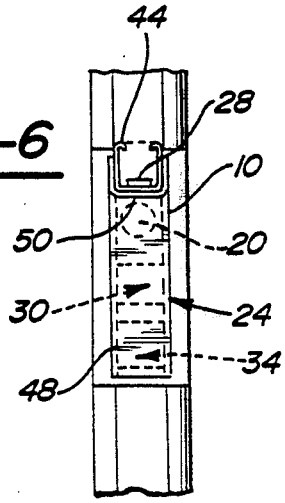
Fig-6

SHELF BRACKET

BACKGROUND OF THE INVENTION

1. Field of the Invention

This invention relates to a shelf bracket, and, more particularly, to a cantilevered shelf support for installation on a vertically extending channel.

2. Description of the Prior Art

Industrial and residential shelving for storage of materials is commonly constructed by bolting shelves directly to vertical structural members such as angles, I-beams and channels. Where height adjustability is a requirement, separate shelf support brackets are commonly used, and the brackets are bolted directly to the vertical structural members or the brackets have a sliding connection with the vertical members which is tightened in some fashion by a bolt and nut connection.

When support brackets are used, separate left and right hand brackets are normally necessary so that the horizontal shelf supporting surfaces of the brackets face each other. Such a support bracket is shown in U.S. Pat. No. 2,719,692; the support bracket has a horizontal shelf supporting surface and a vertical flange which is attached to a specially shaped vertical structural member by a sliding jaw clamp tightened with a bolt and nut connection.

SUMMARY OF THE INVENTION

The present invention is directed to a universal shelf support for attachment to a vertical channel shaped structural member, and it utilizes a separate mounting plate to provide ease in height adjustment while eliminating the requirement for separate right and left hand support members.

The cantilevered shelf support of this invention is installed on a vertically extending channel which has a face containing a longitudinally extending slot bordered by inwardly projecting flanges. A substantially rectangular mounting plate has a channel engaging side with a channel projection for insertion into the channel slot. The other side of the mounting plate is a support bracket side which has a bracket projection. A mounting hole passes through the plate, and there is a vertically extending mounting tab. A nut is slid through the open end of the channel or through the channel slot to engage the interior of the channel and a bolt is passed through the mounting hole to engage the nut for drawing the channel engaging side of the mounting plate into engagement with the channel face.

A support bracket completes the cantilevered shelf support assembly. The bracket has a horizontal shelf engaging surface and a vertically extending bearing surface which engages the support bracket side of the mounting plate. The bearing surface has a recess which receives the bracket projection of the mounting plate for vertical alignment of the plate relative to the channel face. The mounting bracket also has a vertically extending socket for receiving the mounting tab of the mounting plate.

The mounting plate is affixed to the channel with the channel projection extending into the channel slot, and the nut and bolt draws the mounting plate into contact with the channel face. The support bracket is affixed to the mounting plate by bringing the bearing surface of the support bracket into contact with the mounting plate while inserting the mounting tab into the socket with the bracket projection in the recess to align the support bracket relative to the mounting plate and, hence, relative to the vertically extending channel.

The support bracket has spaced substantially triangular shaped side walls with a horizontal shelf engaging surface and a vertical bearing surface defining two legs of the triangle and a bottom wall joining the side wall defines the third leg of the triangle. The spacing between the side walls defines a recess in the bearing surface for receiving the bracket projection for alignment of the support bracket relative to the mounting plate. A channel member is used to form the horizontal shelf engaging surface. The channel member has two side portions, a bottom portion and a slotted top portion, the slotted top portion forming the horizontal shelf engaging surface. The channel is inserted between the two triangular side walls and is welded thereto. A rectangular slot or aperture is located in the bottom portion of the channel to form a vertically extending socket for receiving the mounting tab.

The mounting plate preferably has an opening at its top to receive the channel member and the vertically extending mounting tab extends into the opening to be received in the rectangular slot or aperture in the bottom wall of the channel member as the support bracket is inserted into the opening. The channel member also extends beyond the vertically extending bearing surface into the longitudinally extending slot of the vertically extending channel.

The mounting hole, the channel projection, and the bracket projection are centrally located on the mounting plate in that order below the vertically extending mounting tab. This arrangement best facilitates the alignment of the mounting bracket relative to the vertically extending channel by the bolt which passes through the mounting hole and the adjacent channel projection, and it also facilitates the alignment of the support bracket relative to the mounting plate by the spaced relationship of the vertically extending mounting tab and the channel projection. The channel and bracket projections are formed on the mounting plate by a stamping operation which extrudes the plate into rounded projections having vertically extending side walls to perform the alignment functions.

The advantages and the improvements effected by the cantilevered shelf support of this invention will become more apparent from the following description and the accompanying drawing.

BRIEF DESCRIPTION OF THE DRAWING

FIG. 1 is an exploded perspective view of the cantilevered shelf support of this invention, showing the installation of a mounting bracket on and in alignment with a vertically extending channel, the alignment being accomplished by a channel projection on the mounting plate extending into a channel slot and an affixing nut and bolt connection, and further showing the installation of a support bracket on the mounting plate with relative alignment being effected by cooperation between a vertically extending tab on the mounting plate received in a socket or slot in the support bracket in cooperation with a bracket projection on the mounting plate extending into a recess in the support bracket;

FIG. 2 is a side elevational view of the shelf support according to the invention;

FIG. 3 is a top plan view of the shelf support;

FIG. 4 is a plan detailed view of the mounting plate viewed from the support bracket mounting side showing the relative vertical locations along the center line of the bracket of the vertically extending mounting tab, the mounting hole, the channel mounting projection extending inwardly, and the bracket projection extending outwardly;

FIG. 5 is an end view of the mounting bracket of FIG. 4, and

FIG. 6 is an end view of the support bracket shown in FIGS. 1-3 with the end plate removed.

DETAILED DESCRIPTION OF THE PREFERRED EMBODIMENTS OF THE INVENTION

Referring to the drawing, and particularly to FIG. 1, the cantilevered shelf support 10 is shown in a position in which it is fastened to a vertical structural member in the form of a channel 12 which has a longitudinally extending slot formed and bordered by inwardly projecting flanges 16. Cantilevered shelf support 10 includes mounting plate 18, bolt 20, channel nut 22 and support bracket 24.

Referring to FIGS. 1, 4 and 5, the mounting plate 18 is substantially rectangular, having an opening 26 in its top to receive a portion of support bracket 24 and into which a centrally located vertically extending mounting tab 28 extends. A channel engaging projection 30 is stamped into plate 18 projecting outwardly from channel engaging face 32. A like bracket projection 34 is stamped from the plate 18 adjacent and below the projection 30, projecting outwardly from a support bracket face 36 of the plate. Each of the projections 34 and 36 have a rounded surface with straight sides 38 to perform an alignment function. A centrally located mounting hole 40 extends through the plate between mounting tab 28 and channel projection 30.

Mounting plate 18 is attached to channel 12 at any desirable height location by inserting the channel engaging nut 22 into the interior of channel 12 and passing the bolt 20 through mounting hole 40 in the plate to engage the nut 22. The channel face 32 of the plate is placed against the channel ace 42 with the channel projection 30 extending into slot 14 to vertically align the plate. Typically, the channel nut 22 has a slot or slots 41 which engage the ends of inwardly directed flanges 16 of the channel. Channel nut 22 can be made in accordance with any one of the several teachings such as those set forth in U.S. Pat. Nos. 2,696,139, 3,049,161, 3,053,355, or 4,784,552.

Support bracket 24 is formed with a generally triangular shape having a horizontal shelf engaging surface 44 and a vertically extending bearing surface 46 forming two legs of the triangle at right angles to each other. A single pre-cut plate is bent in a U-shaped cross-section to form the triangular sides 48 and connecting bottom 50. A channel member 52 is inserted between the sides 48 extending outwardly from the sides 48 at its free end 54 and its attachment end 56. Channel member 52 is welded to the triangular sides 48 as shown at weld points 58. The slotted face of the channel member 52 forms the horizontal shelf engaging surface 44 of the bracket. Optionally, the end of the channel member 52 may be closed by end cap 60 which is inserted into the free end 54 with ears 62 engaging within the folded over flanges of the channel member 52. A vertically extending socket in the form of a rectangular slot or aperture 64 is formed in the bottom wall 66 at the attachment end 56 of channel member 52.

Support bracket 24 is attached to the previously attached mounting plate 18 by inserting the end 56 of the channel member 52 into opening 26 of mounting plate 18 and slot 14 of channel 12, bringing the bearing surface 46 of the bracket 24 against the bracket face 36 of mounting plate 18 with the bracket projection 34 of the mounting plate extending into the recess created by the spacing of side plates 48 at the bearing surface 46 of the bracket. Downward movement of the bracket moves the upwardly extending vertical tab 28 into the vertically extending socket or rectangular slot in channel member 52 to hold the support bracket 24 firmly attached to the mounting plate 18 and, consequently, to vertical channel 12.

The cantilevered shelf support of this invention provides an easily assembled and adjustable, sturdy construction with the bracket bolt connection hidden in the fully assembled shelf support. In addition, the U-shaped support bracket with the channel member top, provides an esthetically pleasing appearance for both industrial and residential use.

I claim:

1. A cantilevered shelf support for installation on a vertically extending channel having a face containing a longitudinally extending slot bordered by inwardly projecting flanges comprising, in combination:

a substantially rectangular mounting plate having a channel engaging side with a channel projection for insertion into said channel slot, a support bracket side having a bracket projection, a mounting hole through said plate, and a vertically extending mounting tab;

a nut for engaging the interior of said channel and a bolt passing through said mounting hole engaging the nut for drawing the channel engaging side of said mounting plate into engagement with said channel face; and a support bracket having a horizontal shelf engaging surface and a vertically extending bearing surface for engagement with the support bracket side of said mounting plate with a recess for receiving said bracket projection and a vertically extending socket for receiving said mounting tab;

whereby said mounting plate is affixed to said channel with said channel projection extending into said slot, and said nut and bolt drawing said mounting plate into securing contact with said channel face; and said support bracket is affixed to said mounting plate by bringing said bearing surface into contact with said mounting plate, inserting said mounting tab into said socket with said bracket projection in said recess.

2. The shelf support according to claim 1 wherein said support bracket has spaced substantially triangular shaped side walls with said horizontal shelf engaging surface and vertical bearing surface defining two legs of the triangle and a bottom wall joining said side walls, defines the third leg of the triangle.

3. The shelf support according to claim 2 wherein the spacing between said side walls defines the recess in said bearing surface for receiving said bracket projection for alignment of said support bracket relative to said mounting plate.

4. The shelf support according to claim 2 wherein a channel member between said side walls forms said horizontal shelf engaging surface.

5. The shelf support according to claim 4 wherein said channel member has two side portions, a bottom portion and a slotted top portion, said slotted top portion forming said horizontal shelf engaging surface.

6. The shelf support according to claim 5 wherein an aperture is located in the bottom portion of said channel member forming said vertically extending socket for receiving said mounting tab.

7. The shelf support according to claim 6 wherein one end of said channel member extends beyond said mounting plate into said longitudinally extending slot of said vertically extending channel.

8. The shelf support according to claim 6 wherein said mounting plate has an opening at its top end to receive said channel member, said mounting tab extending into said opening to be received in said aperture as the channel member of said support bracket is inserted into said opening.

9. The shelf support according to claim 1 wherein said vertically extending mounting tab, said mounting hole, said channel projection and said bracket projection are respectively vertically aligned from top to the bottom of said mounting bracket, the bolt through said mounting hole and said channel projection vertically aligning said mounting bracket relative to said vertically extending channel, and said vertically extending mounting tab and said channel projection vertically aligning said support bracket relative to said mounting plate.

10. A cantilevered shelf support for installation on a vertically extending channel having a face containing a longitudinally extending slot comprising, in combination:

a substantially rectangular mounting plate having a channel projection extending from one side for insertion into said channel slot, a bracket projection extending from its other side, a mounting hole extending through said plate, and a vertically extending mounting tab;

a nut for engaging the interior of said channel and a bolt passing through said mounting hole engaging the nut for drawing said mounting plate into engagement with said channel face; and a support bracket having triangular sides, a closed bottom, an open vertical wall and an open top receiving a channel member having a slotted top forming a horizontal shelf engaging surface, said channel member extending beyond said vertical wall with a slot in its bottom wall to receive said vertically extending mounting tab as said bracket projection is received in said open vertical wall to vertically align said support bracket with said vertical wall bearing against said mounting plate.

11. The shelf support according to claim 10 wherein said mounting plate has an opening at its top to receive said channel member, said mounting tab extending into said opening to be received in said slot as the channel member of said support bracket is inserted into the said opening.

* * * * *